US007478808B2

(12) United States Patent
Bernard et al.

(10) Patent No.: US 7,478,808 B2
(45) Date of Patent: Jan. 20, 2009

(54) JOGGING DEVICE FOR A MAIL PROCESSING MACHINE

(75) Inventors: Emmanuel Bernard, Sannois (FR); Jean-Pierre Gregoire, Brie-Comte-Robert (FR); Alain Multignier, Aulnay-Sous-Bois (FR)

(73) Assignee: Neopost Technologies, Bagneux (FR)

( * ) Notice: Subject to any disclaimer, the term of this patent is extended or adjusted under 35 U.S.C. 154(b) by 437 days.

(21) Appl. No.: 10/987,546

(22) Filed: Nov. 12, 2004

(65) Prior Publication Data

US 2005/0189269 A1 Sep. 1, 2005

(30) Foreign Application Priority Data

Nov. 24, 2003 (FR) ..... 0313711

(51) Int. Cl.
*B65H 9/16* (2006.01)

(52) U.S. Cl. ..... 271/248; 271/145; 271/169; 271/223; 271/226; 271/253

(58) Field of Classification Search ..... 209/583; 271/145, 169, 223, 226, 248, 253
See application file for complete search history.

(56) References Cited

U.S. PATENT DOCUMENTS 2,650,109 A * 8/1953 Johnson ..... 209/612
4,556,211 A * 12/1985 Carr ..... 271/221
4,892,656 A * 1/1990 Pietzsch ..... 210/232
5,292,117 A * 3/1994 Takagi et al. ..... 271/234
5,511,774 A * 4/1996 Lyga ..... 271/273
5,628,504 A * 5/1997 Lyga ..... 271/171
5,927,708 A 7/1999 Baldino et al. ..... 271/171
6,050,054 A * 4/2000 Van Lierde et al. ..... 53/284.3
6,523,822 B1 * 2/2003 Galtier et al. ..... 271/171
2003/0127364 A1 * 7/2003 Salomon ..... 209/1
2006/0237346 A1 * 10/2006 Fridman et al. ..... 209/288

FOREIGN PATENT DOCUMENTS

FR 2003/0127364 A1 1/2003 ..... 209/1

* cited by examiner

*Primary Examiner*—Patrick H Mackey
*Assistant Examiner*—Kalyanavenkateshware Kumar
(74) *Attorney, Agent, or Firm*—Sughrue Mion, PLLC

(57) ABSTRACT

In a mail processing machine having a receive deck for receiving a stack of mail items for printing, jogging means for jogging the stack of items against a reference wall, selection means for extracting mail items for printing one by one from stack of items, and print means for printing a postal imprint on the selected mail item, a jogging device is provided that includes an external strip slidably mounted on a moving slideway and having a jogging flat mounted at the terminal end thereof, a brake-forming friction shoe secured to the stationary slideway and mounted between the stationary slideway and the moving slideway, and a resilient element having one end connected to the moving slideway and its other end connected to the external strip in order to cause the external strip to back off automatically through a determined distance from the moving slideway once the jogging flap has been brought into contact with the stack of mail items.

9 Claims, 7 Drawing Sheets

JOGGING DEVICE FOR A MAIL PROCESSING MACHINE

CROSS-REFERENCE TO RELATED APPLICATIONS

This application claims priority from French Patent Application No. 03 13711 filed Nov. 24, 2003.

BACKGROUND OF THE INVENTION

1. Field of the Invention

The present invention relates exclusively to the field of mail processing, and more particularly it relates to a device for jogging mail items and intended for fitting to a module for feeding a mail processing machine with mail items.

2. Brief Description of Related Developments

A device for jogging mail items that acts directly on the lateral positioning (and possibly also the rear positioning) of mail items is essential in a mail processing machine, since without jogging, the mail items are not presented in a suitable position to the station for printing the postal imprints, and as a result the imprint might be refused by the postal authorities. The device must also be retractable so as to leave room to pass mail items of large dimensions.

U.S. Pat. No. 5,628,504 discloses a lateral jogging device which can be moved transversely between two guide positions corresponding to two determined envelope widths. That device therefore cannot pass mail items of size larger than the larger of the two widths, unlike the device in U.S. Pat. No. 5,927,708 which includes a telescopic member that can pivot to allow such items to pass through, and also items of great thickness. Nevertheless, such pivoting presents the drawback of requiring means for holding the telescopic member in a high position, which means are relatively complex, and this high position on the transport path puts a limit on the thickness of the stack of large-sized mail items that can be jogged. In addition, it can be seen that the stack of mail items is not accurately compressed with such a telescopic system, and the system is also somewhat unsightly.

SUMMARY OF THE INVENTION

An object of the present invention is thus to mitigate the above-mentioned drawbacks by means of an improved jogging device enabling an optimum amount of stress to be applied on the stack of mail items. An object of the invention is also to propose a device that enables a stack of large-sized mail items (typically greater than 200 millimeters (mm)) to be processed, the height of the stack exceeding a mean value of 150 mm. Another object of the invention is to propose a device that is easy to integrate in a conventional mail processing machine without needing to redefine the general architecture of the machine.

These objects are achieved with a jogging device for a mail processing machine having a receive deck for receiving a stack of mail items for printing, a jogging device for jogging said stack of items against a reference wall, selection means for extracting mail items for printing one by one from the stack of items, and print means for printing a postal imprint on the selected mail item, said jogging device comprising a jogging flap and a moving slideway sliding on a stationary slideway having one end secured close to said reference wall above the transport path of mail items, the jogging device further comprising an external strip slidably mounted on said moving slideway and having the jogging flap mounted on its terminal end, a brake-forming friction shoe secured to said stationary slideway and mounted between said stationary slideway and said moving slideway, and a resilient element having one end connected to said moving slideway and its other end connected to said external strip in order to cause said external strip to back off automatically through a determined distance relative to said moving slideway once the jogging flap has been brought into contact with said stack of mail items.

Thus, by this simple structure of a strip sliding on the external slideway, optimum jogging of the stack of mail items is obtained, thereby enabling them to be compressed without excess.

The determined backing-off distance is given by the compressed length of a compression spring forming said resilient element. Advantageously, said friction shoe is dimensioned to apply a friction force greater than the force obtained by compressing said compression spring.

Preferably, said jogging flap is hinged to the terminal end of said external strip both about a vertical axis and about a horizontal axis. It further comprises a resilient element for pulling the flap downwards against said receive deck while it is pivoting about said vertical axis. This resilient element is formed by a traction spring mounted between a first stud secured to the jogging flap and a second stud secured to a support part having one end mounted to pivot about said horizontal axis and having its other end mounted to slide in a groove in the jogging flap. The device may further comprise a part that carries a heel forming a secondary jogging element, that is hinged about an axis carried by the support part, and that is provided with an oblong groove that co-operates with a peg on said jogging flap.

Advantageously, said jogging flap further comprises a shaft which, during pivoting of the flap, causes a locking part to engage in an orifice of the external strip in order to lock the flap in the jogging position.

The invention also provides any mail processing machine that includes the above-specified jogging device.

BRIEF DESCRIPTION OF THE DRAWINGS

The invention will be better understood in the light of the following detailed description accompanied by non-limiting illustrative examples given with reference to the following figures, in which.

DETAILED DESCRIPTION OF EMBODIMENTS

Figure 1:
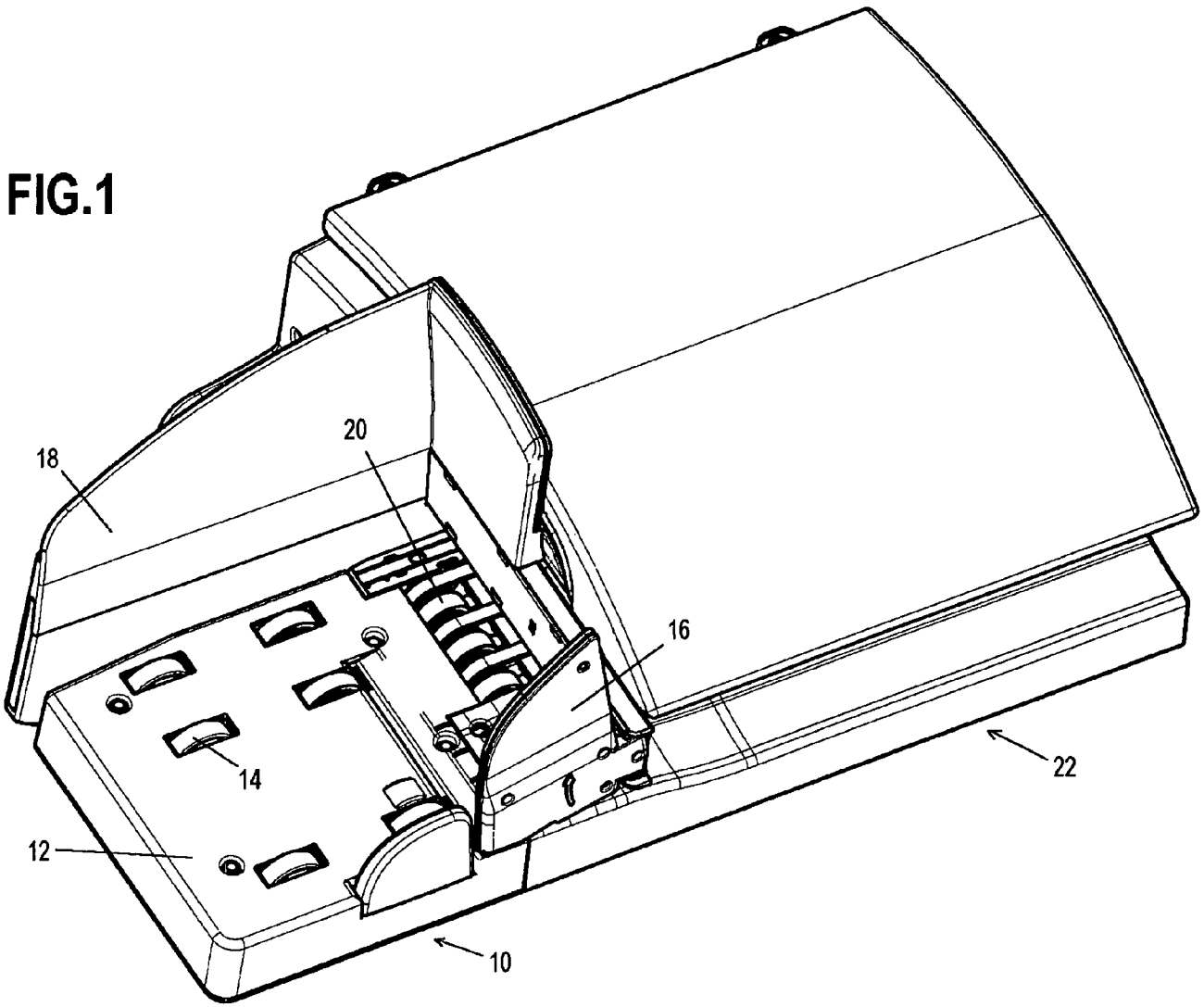
FIG. 1 is a perspective view of a mail processing machine including a jogging device of the invention.

A mail processing machine including a jogging device of the invention is shown in FIG. 1. In conventional manner, going from upstream to downstream (in the direction mail items travel through the machine) it comprises: a mail item feed station 10 having a receive deck 12 on which mail items for printing are placed in a compact stack which may be uniform or otherwise (depending on whether the items are all of the same dimensions or not); drive rollers 14 for conveying the mail items through the machine along a mail item transport path; a lateral jogging device for jogging the mail items against a reference wall 18 whose upper portion slopes backwards; a selection station 20 for extracting mail items for printing one by one from the bottom of the stack; and a print station 22 for printing a postal imprint on the mail item selected in this way. Depending on its degree of sophistication, the machine may also include means closing and sealing mail items, and possibly internal means for weighing mail items.

Figure 2:
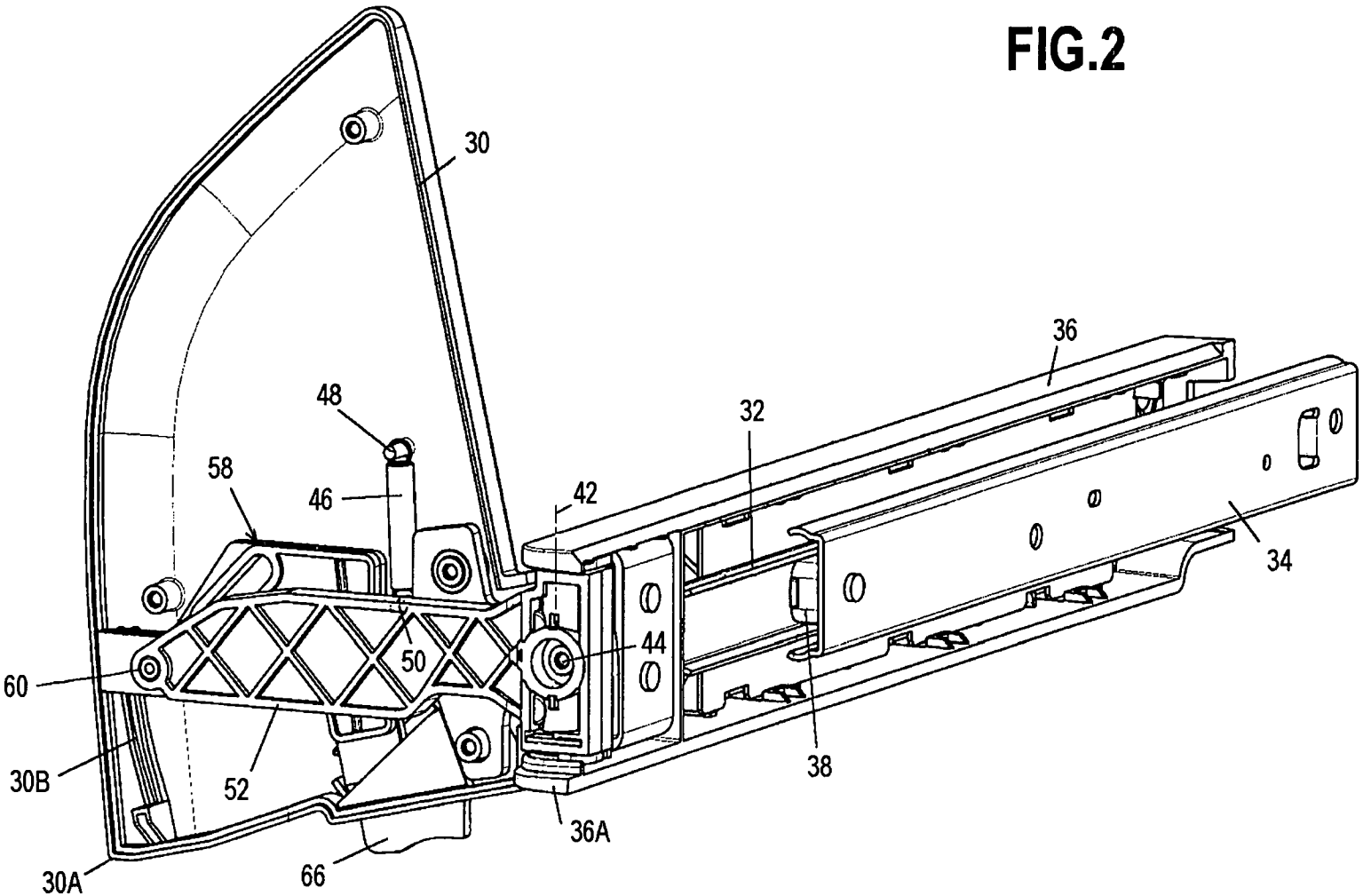
FIGS. 2 and 3 are an elevation view and a section view of the jogging device of FIG. 1.
Figure 3:
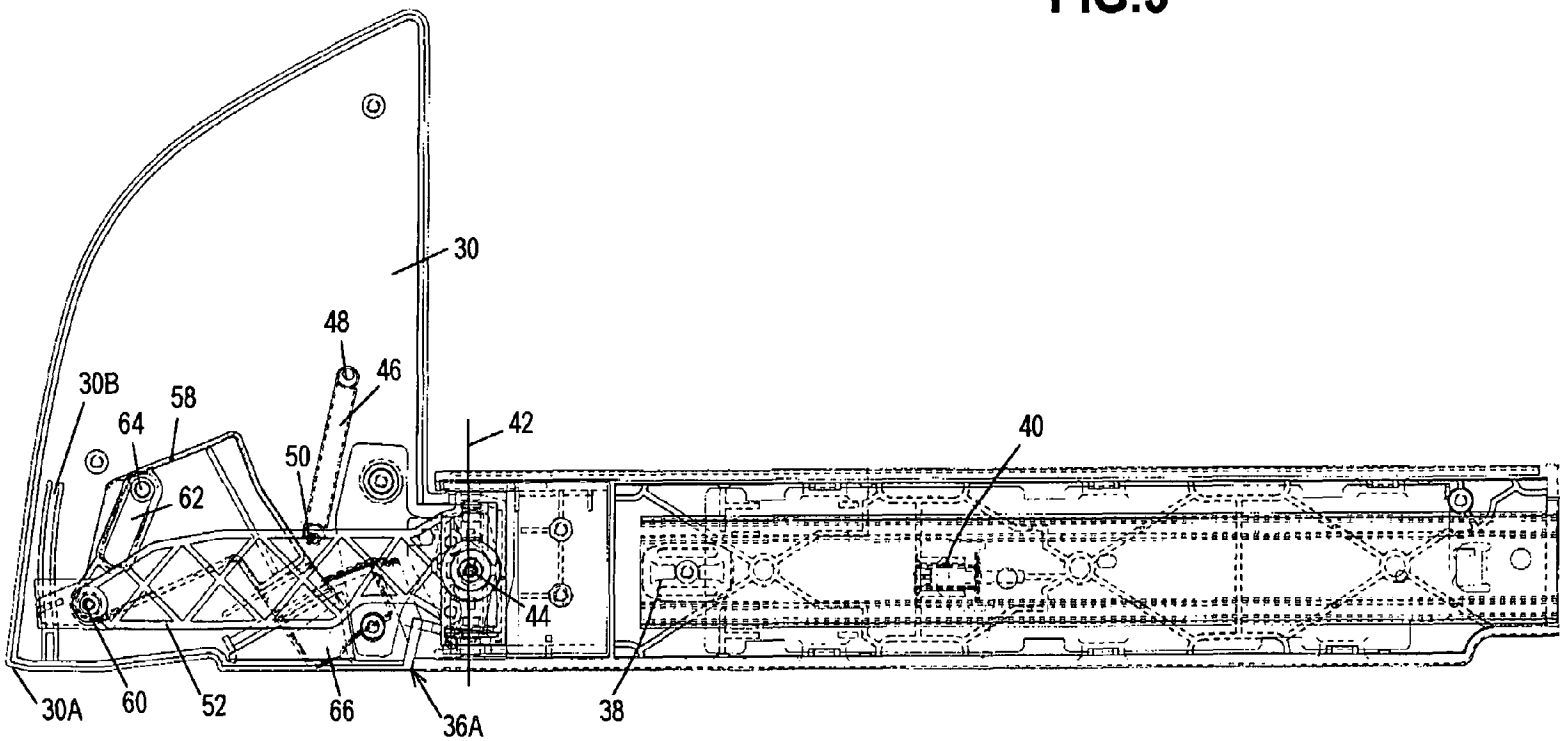

In the invention, and as shown in detail in FIGS. 2 and 3, the jogging device comprises a moving slideway 32 which slides externally on a stationary ball slideway 34. The moving slideway is mounted in an external protective strip 36 which can itself slide on the moving slideway through a very short predetermined distance, and which carries at its terminal end a jogging flap 30 that is hinged thereto.

In order to avoid envelopes being flattened against the reference wall (or item-guide) 18, an automatic mechanism is provided for backing off the jogging device, which mechanism is formed by a brake-forming friction shoe 38 and a compression spring 40 having one end connected to the moving slideway 32 and its other end connected to the external protective strip 36. The friction shoe 38 is secured to the stationary slideway 34 between the moving slideway and the stationary slideway, and it is of dimensions suitable for applying a friction force greater than the force obtained by compressing the spring, so as to ensure that it is maintained automatically in the jogging position selected by the operator as a function of the width of the stack of envelopes. The spring 40 is compressed by the operator when pushing the jogging flap that is mounted at the end of the strip against the stack of envelopes, thereby also moving the moving slideway which is secured thereto along the stationary slideway. When the flap 30 comes into abutment against the stack and the operator then lets go the flap, the spring expands to return into its initial free state, backing off the strip through a determined distance of a few millimeters (e.g. 4 mm), i.e. moving the strip backwards through a fixed distance corresponding to the compressed length (compressed height) of the spring, while the moving slideway continues to be held in position by the brake shoe. This ensures that no envelope is deformed, although the stack remains suitably pressed against the item-guide.

Furthermore, the jogging device does not hinder or prevent large-format or thick envelopes passing through. Thus, the jogging flap 30 can take up two distinct positions: a rest or inactive position in which the flap must be capable both of being folded over the envelope transport path at a height that is greater than the maximum thickness of an envelope, i.e. about 20 mm, and allow documents of very large format to pass through (greater than the width of the receive deck, i.e. about 200 mm), and an active position in which the flap is folded down onto the working path, with the bottom end 30A of the flap coming down from said maximum height to a minimum height that is suitable for retaining thin envelopes, typically about 2 mm thick.

Figure 7:
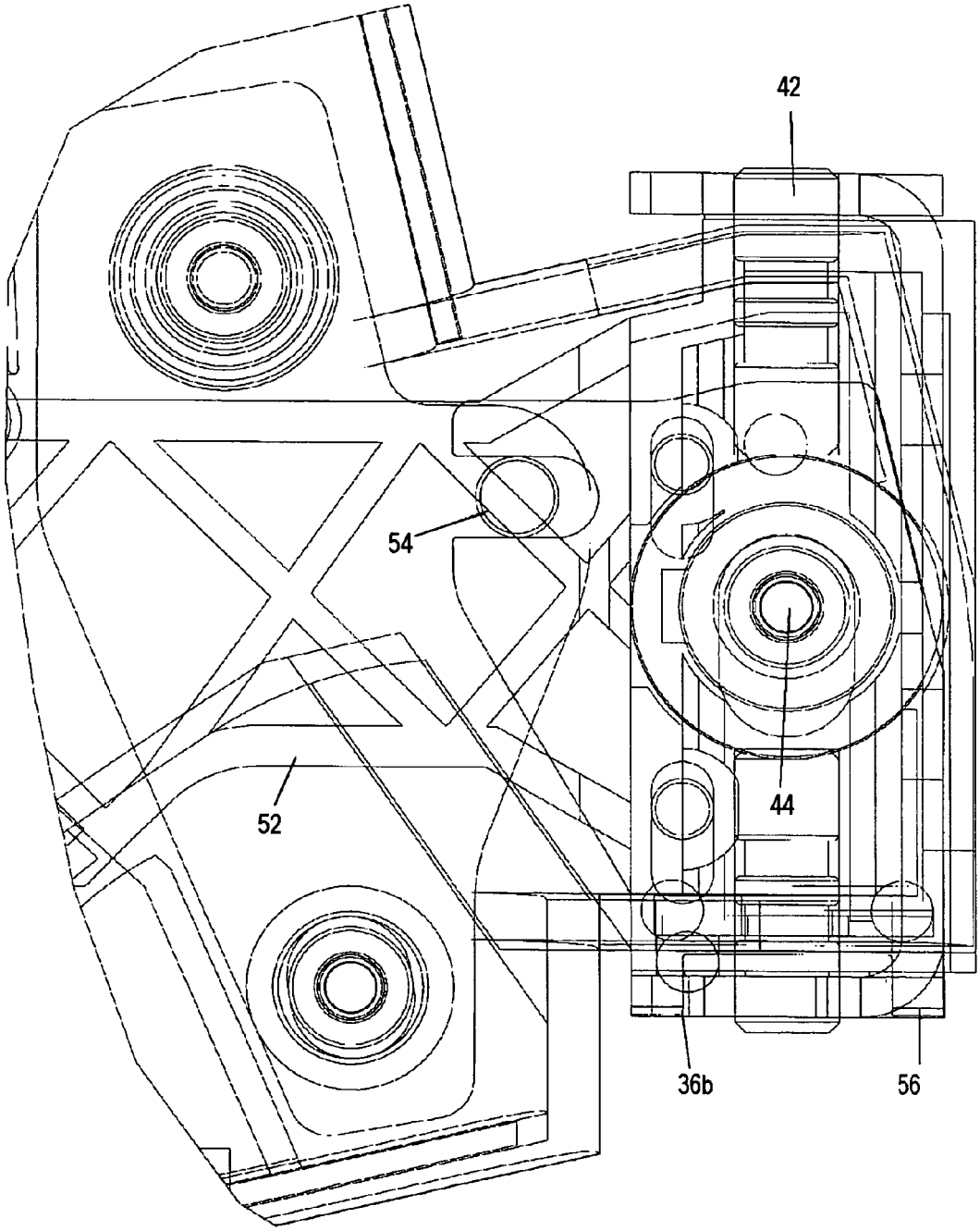
FIG. 7 is an enlarged view of a portion of FIG. 6 showing the means for locking the flap in the jogging position.

The jogging flap 30 is hinged both about a vertical axis 42 which enables it to pivot through 900 from the inactive position in line with the strip 36 to the conventional active position parallel to the reference wall 18, and also about a horizontal axis 44 which enables the flap to move downwards as described above as it pivots under drive from a resilient element 46. While it is pivoting about its vertical axis, its bottom axis 30A co-operates with a cam surface 36A of the strip. The resilient element, a traction spring, which enables the flap to be pulled downwards, is mounted between a first stud 48 secured to the flap and a second stud 50 secured to a support part 52 having one end mounted on the horizontal axis 44 and its other end capable of sliding in a slot 30B of the flap. Opening the flap towards its active position by pivoting about the vertical axis 42 also causes it to turn about the horizontal axis 44 under traction from the spring 46 until the bottom end 30A of the flap comes to rest against the receive deck 12. As it moves downwards, the flap moves a shaft 54 which is secured thereto, thereby entraining a locking part 56 which becomes engaged in a corresponding orifice 36B of the strip, locking the flap in the jogging position (see FIG. 7). To return to the inactive position, the operator must begin by lifting the flap by pivoting it about the horizontal axis 44 prior to folding it against the flank of the strip by pivoting about its vertical axis 42.

Figure 4:
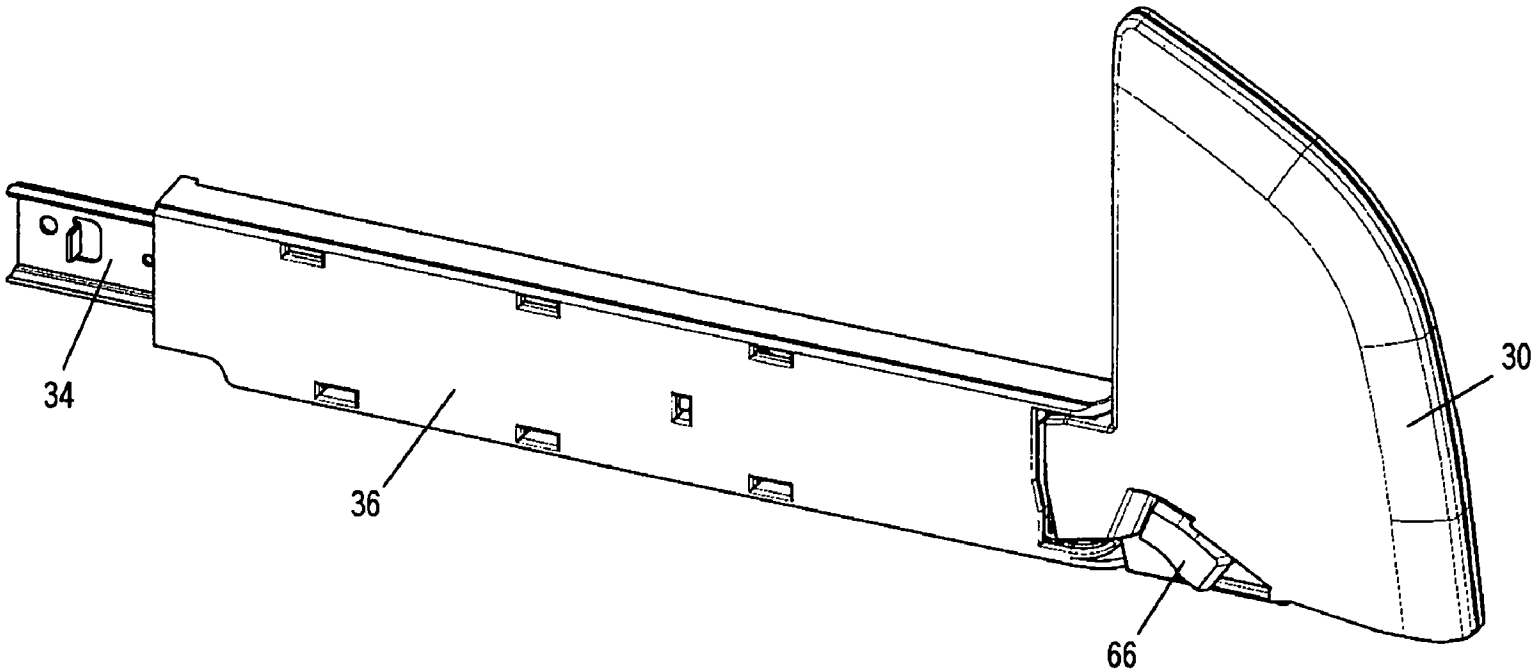
FIGS. 4 and 5 are outside views of the FIG. 2 jogging device in its two operating positions.
Figure 5:
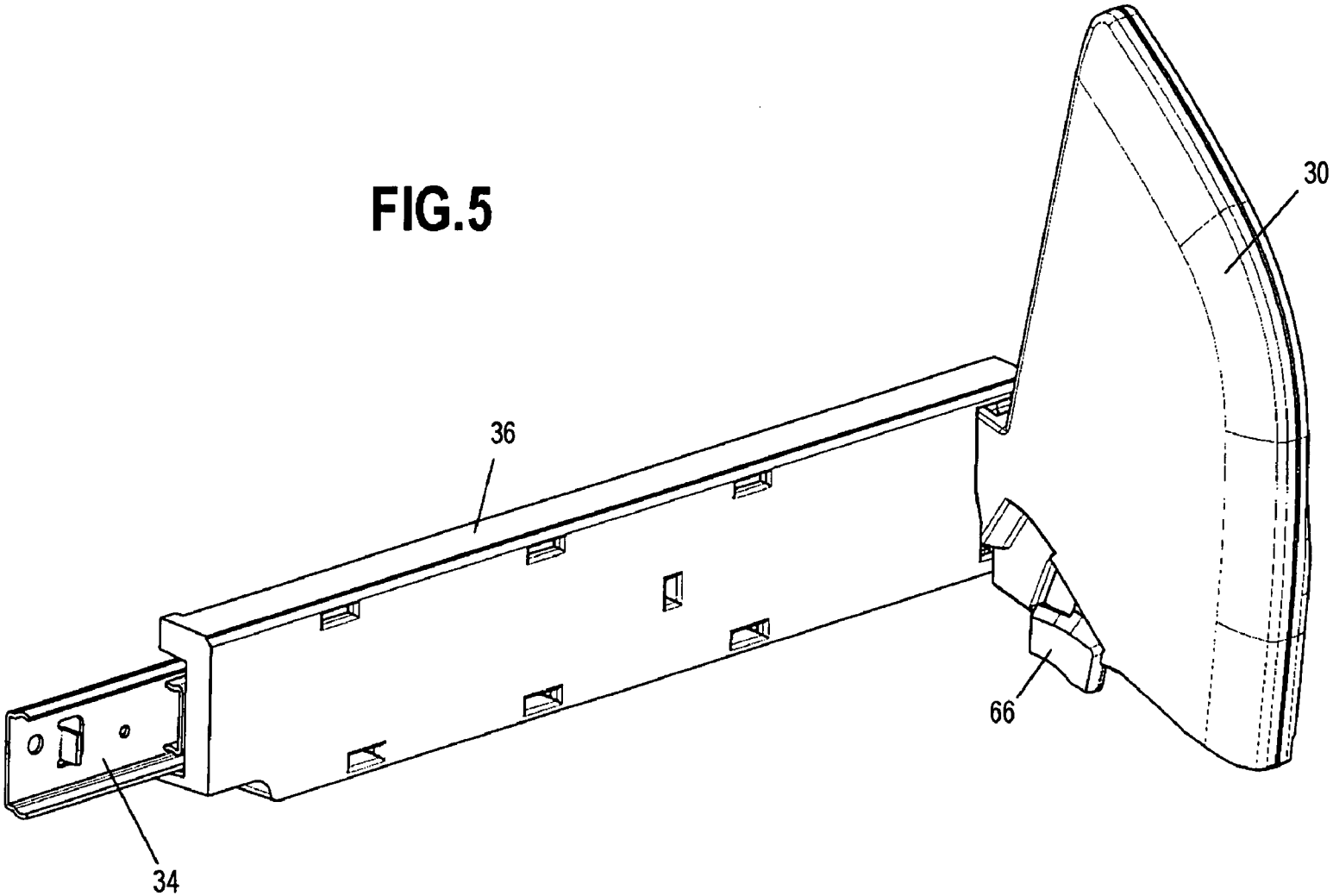
Figure 6:
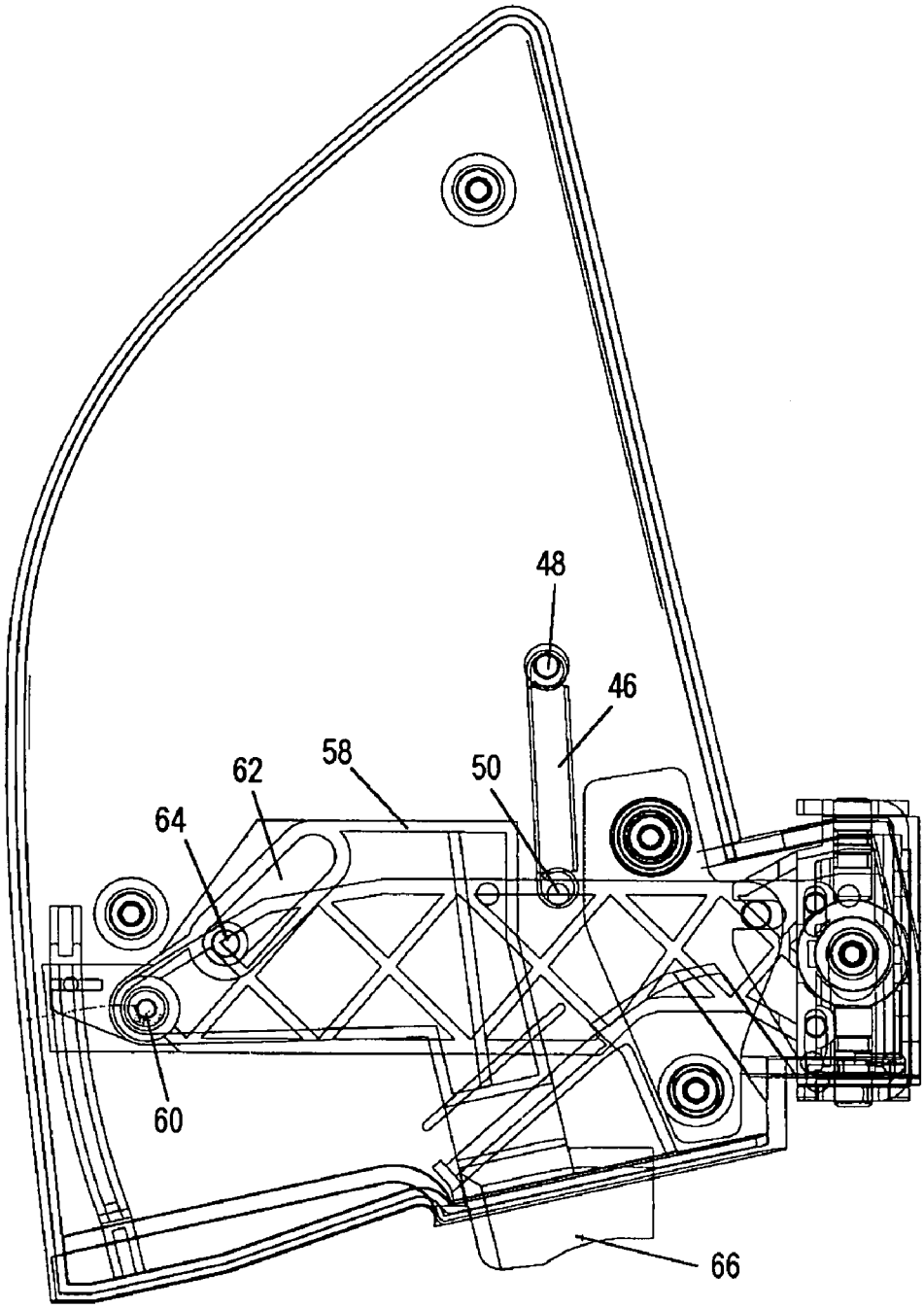
FIG. 6 is a detail view of the jogging flap of the preceding figures.

The two positions of the jogging flap can be seen more clearly in FIGS. 4 and 5 which are outside views of the jogging device respectively in its active jogging position (flap at 900, parallel to the item-guide 18), and in its inactive position for allowing items of large dimensions to pass through (flap in line with the strip). In these two figures, there can clearly be seen the "extended" and "retracted" positions of a secondary jogging mechanism of structure and function described below with reference to FIG. 6.

While the flap is being pivoted about its horizontal axis 44, an empty space is created under the flap which could lead to mail items becoming skewed in the secondary jogging mechanism. This mechanism comprises a part 58 that is hinged about an axis 60 secured to the support piece 52 and provided with an oblong 62 which co-operates with a peg 64 on the jogging flap 30. As the jogging flap moves downwards, the peg 64 of the flap moves down in the oblong slot 62 entraining the hinged part 58 in a pivoting movement, thereby extending a heel 66 of this part beneath the flap to form the secondary jogging element proper, thereby filling in part of the above-mentioned empty space and thus ensuring that envelopes are properly guided on the selection means. The special shape of the bottom portion of the heel should be observed which enables it to pass over the selection rollers for envelopes of small size.

What is claimed is:

1. In a mail processing machine having a receiving deck for stacking mail items for printing and a selector for extracting a mail item from the stack for delivery to a print station along a transport path, a jogging device for jogging the stack of mail items against a reference wall comprising:

a stationary slideway fixed on the mail processing machine and extending from the reference wall across the transport path along a longitudinal axis;

a moveable slideway mounted on the stationary slideway for sliding motion along the longitudinal axis;

a friction shoe secured to the stationary slideway and engaging the moveable slideway to generate a friction force on the moveable slideway to maintain the position of the moveable slideway;

an external strip mounted on the moveable slideway for movement, thereon relative to the moveable slideway, a predetermined distance along the longitudinal axis, the external strip being biased by a resilient element for sliding movement away from the reference wall for the predetermined distance;

a jogging flap mounted at an end of the external strip that is away from the reference wall, said jogging flap, extending in alignment with the transport path, transverse to the longitudinal axis, wherein said jogging flap may be moved with the moveable slideway and the external strip into contact with the stack of mail items;

wherein, upon contact with the stack of mail items, the jogging flap is backed off via movement of said external strip through said predetermined distance by the bias force of the resilient element; and wherein said jogging flap is hinged to the end of said external strip both about a vertical axis and about a horizontal axis.

2. A jogging device for a mail processing machine according to claim 1, wherein said resilient element is a compression spring.

3. A jogging device for a mail processing machine according to claim 2, wherein the predetermined distance is given by the compressed length of the spring.

4. A jogging device for a mail processing machine according to claim 2, wherein said friction shoe is dimensioned to apply a friction force greater than the force obtained by compressing said compression spring.

5. A jogging device for a mail processing machine according to claim 1, wherein said jogging flap further comprises a second resilient element for pulling the flap downwards against said receiving deck while it is pivoting about said vertical axis.

6. A jogging device for a mail processing machine according to claim 5, wherein said second resilient element is formed by a traction spring mounted between a first stud secured to the jogging flap and a second stud secured to a support part having one end mounted to pivot about said horizontal axis and having its other end mounted to slide in a groove in the jogging flap.

7. A jogging device for a mail processing machine according to claim 6, comprising a part that carries a heel forming a secondary jogging element, that is hinged about an axis carried by the support part, and that is provided with an oblong groove that co-operates with a peg on said jogging flap.

8. A jogging device for a mail processing machine according to claim 5, wherein said jogging flap further comprises a shaft which, during pivoting of the flap, causes a locking part to engage in an orifice of the external strip in order to lock the flap in the jogging position.

9. A mail processing machine comprising:

a receiving deck for stacking mail items for printing;

a selector for extracting a mail item from the stack for delivery to a print station along a transport path; and a jogging device for jogging the stack of mail items against a reference wall further comprising:

a stationary slideway fixed on the mail processing machine and extending from the reference wall across the transport path along a longitudinal axis;

a moveable slideway mounted on the stationary slideway for sliding motion along the longitudinal axis;

a friction shoe secured to the stationary slideway and engaging the moveable slideway to generate a friction force on the moveable slideway to maintain the position of the moveable slideway;

an external strip mounted on the moveable slideway for movement thereon a predetermined distance along the longitudinal axis, the external strip being biased by a resilient element for sliding movement away from the reference wall for the predetermined distance;

a jogging flap mounted at an end of the external strip that is away from the reference wall said jogging flap, extending in alignment with the transport path, transverse to the longitudinal axis, wherein said jogging flap may be moved with the moveable slideway and the external strip into contact with the stack of mail items;

wherein, upon contact with the stack of mail items, the jogging flap is backed off from said contact via movement of said external strip through said predetermined distance by the bias force of the resilient element; and wherein said jogging flap is hinged to the end of said external strip both about a vertical axis and about a horizontal axis.

* * * * *